United States Patent [19]

Persson

[11] Patent Number: 4,915,154

[45] Date of Patent: Apr. 10, 1990

[54] COUNTER REFLECTOR AND METHOD OF DRYING A WEB WITH THE AID OF SAME

[75] Inventor: Per Persson, Trollhättan, Sweden

[73] Assignee: Infrarodteknik AB, Sweden

[21] Appl. No.: 141,602

[22] PCT Filed: Apr. 27, 1987

[86] PCT No.: PCT/SE87/00214

§ 371 Date: Dec. 23, 1987

§ 102(e) Date: Dec. 23, 1987

[87] PCT Pub. No.: WO87/06636

PCT Pub. Date: Nov. 5, 1987

[30] Foreign Application Priority Data

Apr. 28, 1986 [GB] United Kingdom ..... 8610302

[51] Int. Cl.[4] ..... F26B 13/20

[52] U.S. Cl. ..... 162/207; 34/4; 34/39; 34/41

[58] Field of Search ..... 34/4, 39, 41; 162/206, 162/207

[56] References Cited

U.S. PATENT DOCUMENTS 4,513,516 4/1985 Björnberg ..... 34/41

4,594,795 6/1986 Stephansen ..... 34/41 X

*Primary Examiner*—Kenneth M. Schor

*Assistant Examiner*—Thi Dang

*Attorney, Agent, or Firm*—Davis, Bujold & Streck

[57] ABSTRACT

A counter reflector for use in drying webs, e.g. in a paper making machine, receives heat radiation, which has passed through the paper and returns the energy to the web by reflection. The counter reflector consists of a frame, glass ceramic shields (5) facing the paper web and having a chamber (14) to be pressurized with a drying gas, which issues through openings (10, 11, 12, 13) in and between the glass ceramic shields (5) and thus, the said of the paper web facing the counter reflector is dried by reflected heat radiation as well as warm gas flow in a continuous and steady way, resulting in easily controlled drying/curing conditions in the paper web. The issuing gas flow also serves to pressurize and thus stabilize the space between the counter reflector and the adjacent web and to keep away the latter from the former when saturated with heat. The counter reflector is provided to entrap all further heat which is generated in the drying/curing zone.

10 Claims, 3 Drawing Sheets

COUNTER REFLECTOR AND METHOD OF DRYING A WEB WITH THE AID OF SAME

The present invention relates to a counter reflector, e.g. in a paper making machine. It is designed to reflect heat radiation, particularly infra-red (IR) radiation, which issues within a drying zone from heating elements, such as IR-elements with reflectors, penetrates a continuous running paper web, and is reflected back to the paper web. Thus, heat radiation, which penetrates the paper web, is recovered by means of the counter reflector, which is placed opposite to said heating elements with reflectors and thus, the energy supplied to the paper making machine can be highly exploited. The invention also relates to a method of drying a web with the aid of such a counter reflector.

It has further been proposed to produce a counter reflector from an IR-reflecting material, e.g. an aluminium plate. A disadvantage of these known counter reflectors is that the reflection appears to lack a continuous and uniform impact on the drying conditions of the advancing paper web. The reflected heat radiation fluctuates considerably as to direction and intensity, partly due to the fact that heat disappears as radiation from the opposite side of the counter reflector and that the latter is substantially unable to store heat.

According to the present invention, a most uniform counter reflector can be achieved, which is favourable to the overall energy economy and the drying/curing efficiency of a paper making machine, with a counter reflector having a major reflecting surface of shields with radiant heat conserving properties. The counter reflector shields are preferably glass ceramics. However other materials such as ceramic materials coated with glass, glass, glass coated with ceramic material may be used. Alternatively steel or nickel plates coated with alumina and/or magnesium oxide by flame spraying or plasma spraying can be used for the shields. Flame spraying is usually carried out at a temperature of 4000–5000 degrees Celcius and plasma spraying at 15000–30000 degrees.

The shields are preferably backed up by an insulation layer consisting of ceramic fibres, such as aluminium silicate having a high degree of purity and resistance to heat, or the like. Furthermore, the counter reflector is preferably built up by means of a surrounding frame of square steel tubes, within which extends a lattice-like support for carrying said shields and said insulating layers, which may be arranged in groups of six within tray-shaped boxes of thin metal sheet.

A preferred method of attaching the shields, layers and boxes to the lattice-like support is by means of hollow copper rivets. Slot-like openings are left between adjacent boxes. Spaced apart and behind the shields a rear wall closes the rear side of the counter reflector and forms a chamber which can be pressurized with a gas, preferably compressed air. The gas can flow through the slot-like openings towards the paper web, so that the web receives both radiation reflected from the surface of the shields and warm air heated by the radiation absorbed by the counter reflector. The issuing gas flow also serves to pressurise and thus to stabilise the space between the counter reflector and the adjacent web.

The counter reflector supplies heat radiation into its inner portion or chamber and is able to absorb large amounts of heat. However, it is also able to emit the stored heat again in the opposite direction as heat radiation. Thus, it has a pronounced capacity to give off a continuous and even heat radiation. When saturated with heat, the counter reflector will entrap all further heat which is generated in the drying/curing zone. Furthermore, the counter reflector of the present invention can withstand temperature shocks, as it has only a small linear thermal coefficient of expansion. It is stable at high temperatures, up to about 700 degrees Celcius, as well as in a mechanical sense and is not easily warped. The smooth upper surface of the shields stays substantially clean and is easily cleaned, a feature of the greatest importance in the environment of a paper making machine, in connection with the fact, that such a surface does not change its appearance and properties to any substantial extent.

BRIEF DESCRIPTION OF THE DRAWINGS

A preferred embodiment of the counter reflector of the present invention will now be described with reference to the accompanying drawings, in which.

DETAILED DESCRIPTION OF THE DRAWINGS

Figure 1:
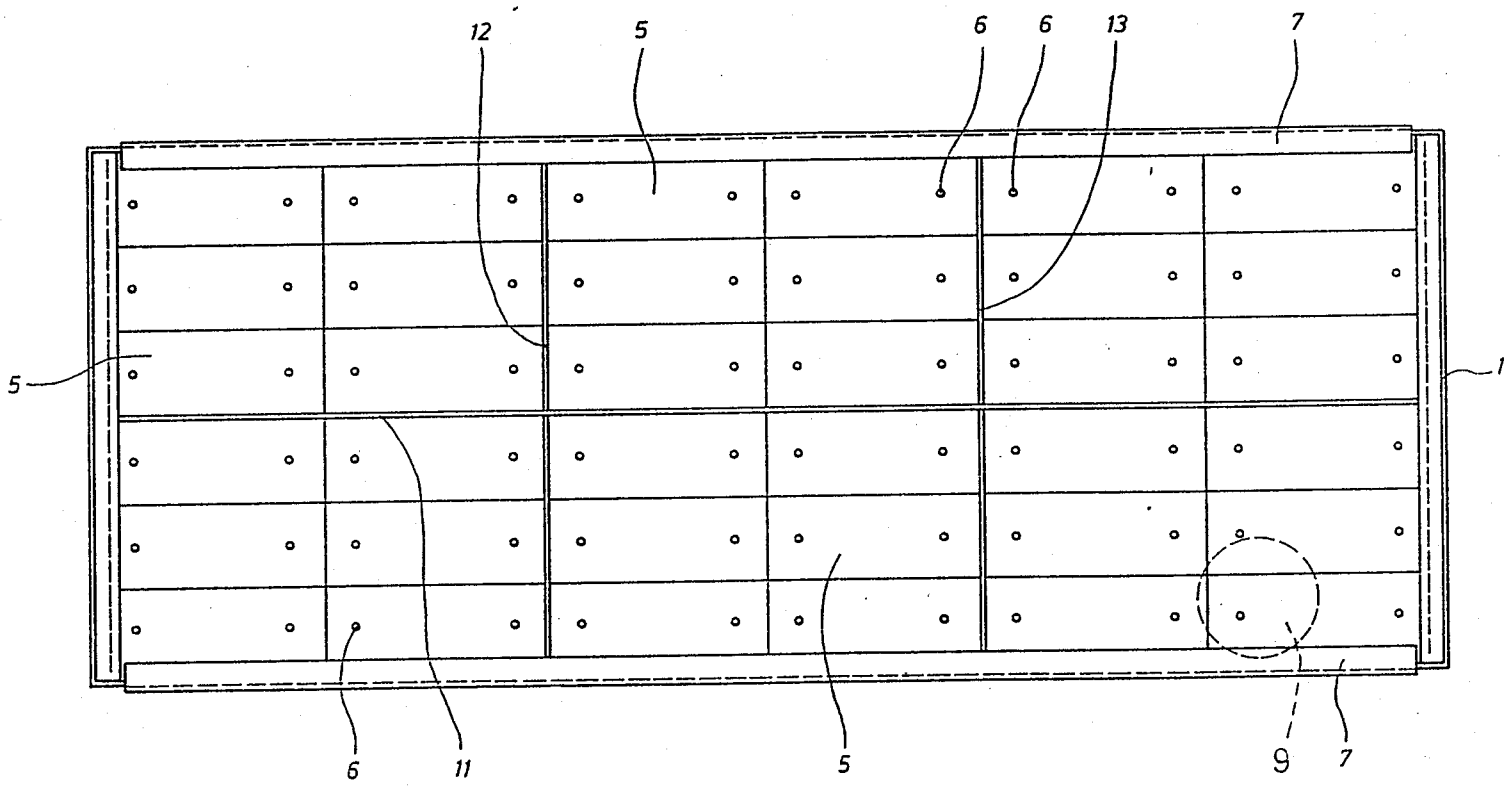
FIG. 1 is a planar view of a counter reflector according to the present invention.
Figure 3:
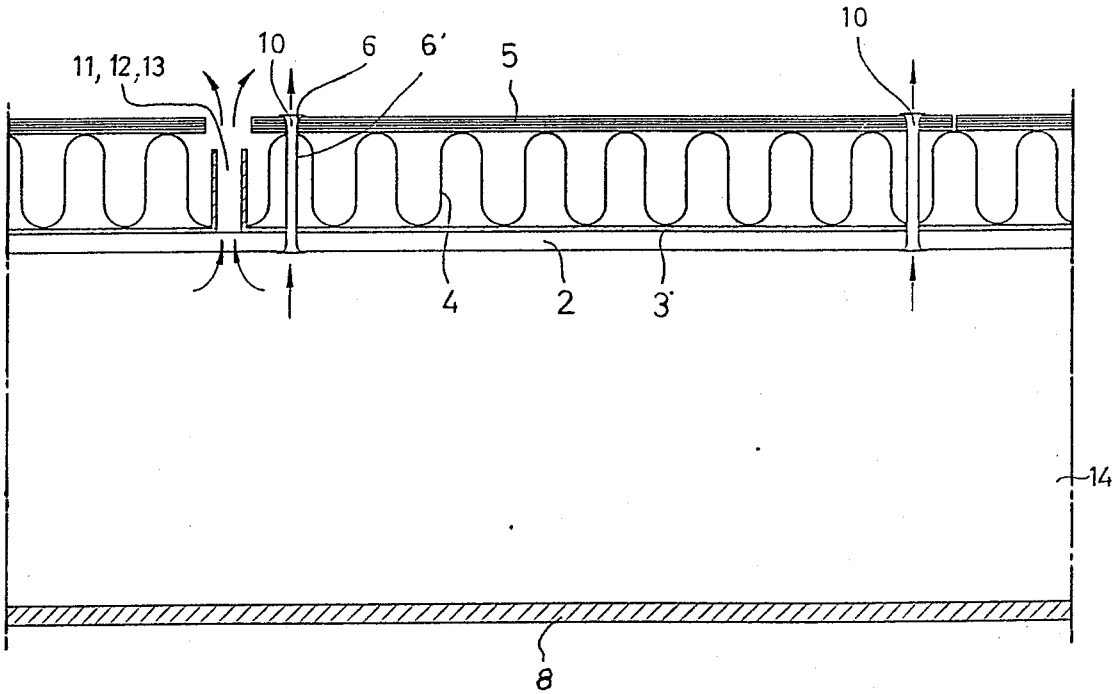
FIG. 3 is a portion of a cross section of the counter reflector shown in FIGS. 1 and 2, enlarged about ten times compared with the other Figures.
Figure 2:
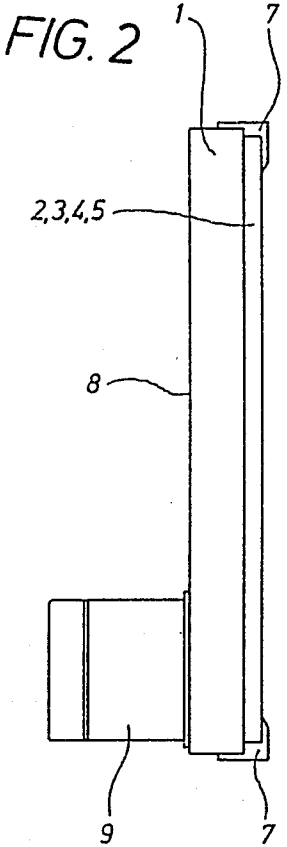
FIG. 2 is a lateral view of the counter reflector shown in FIG. 1.

A preferred embodiment of the counter reflector according to the present invention, see FIG. 1, comprises a frame 1 and a lattice-like supporting structure 2, made of flat steel bars is attached to the frame 1. Six tray-shaped boxes 3, are attached to the outer surface of the structure 2.

All the boxes 3 are filled with a heat insulating layer of ceramic fibres 4. 36 minor glass ceramic shields 5, each having two holes 6 are fastened to the supporting structure 2. The fastening means are rivets or screws 6', which are preferably made of copper and have a hollow central bore 10. The ceramic fiber layers 4 are held in place by the glass ceramic shields 5 as well as the structure 2 and the rear surfaces of the boxes 3 respectively.

Profiled mouldings 7 of steel or bare aluminium protect the edges of the counter reflector. A plate 8 of stainless steel is attached to the opposite side of the frame and provides a closed rear face for the counter reflector. The inner portion of the counter reflector, a chamber 14, is fed with a gas under pressure, preferably compressed air, by means of a gas feed means 9. Radiation which is not reflected by the surface of the glass ceramic shields 5 is absorbed by them heating the shields and the associated ceramic fibres 4. It should, however, be noted that the direct reflection from the glass ceramic shields is minimal, so that about 10 percent of the heat radiation is absorbed by them and most of the remainder by the insulating layers. Gas passing through the chamber 14 absorbs excess heat from the shields and fibres while its own temperature is increased. The heated gas issues from the chamber 14 through the structure 2. Heated gas also passes through at least some of the boxes 3 via the hollow rivets 6' in the holes 6 in the shields 5.

The heated gas issues through slots between the boxes and the glass ceramic shields in three sheet-shaped and quite concentrated gas streams; namely through an extended slot 11 along the longer side of the boxes 3 and two shorter slots 12 and 13, perpendicular to the extended one. These gas streams have absorbed excess heat from the counter reflector and the emergent hot gas asssits in the drying of the wet paper web 28. The main purpose of the gas flow is, however, to pressurize and stabilize the space between the counter reflector and the adjacent web, thus keeping away the latter from the former, which is a matter of safety but also contributes to the uniform drying/curing conditions. It will thus be seen that the counter reflector according to the invention accepts radiation emerging from the one (rear) side of a radiation heated paper web and absorbs and/or reflects this radiation. The reflected (minimum part of) radiation is returned to the web while the absorbed (maximum part of) radiation is used mainly to create a buffer zone, as the counter reflector when saturated with heat will entrap all further heat which is generated in the drying/curing zone. The absorbed or entrapped excess heat is partly reradiated to the paper web and partly absorbed by the gas passing through the chamber to the space between the shields 5 and the web 28.

Figure 4:
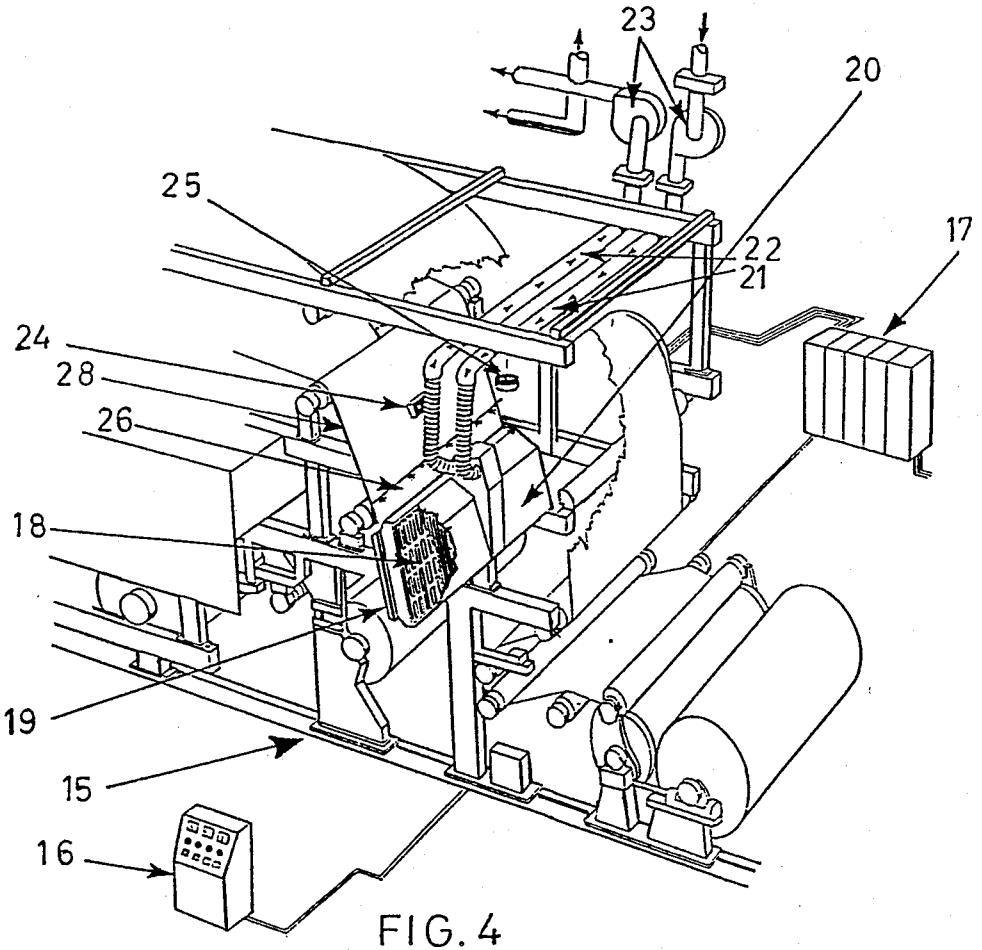
FIG. 4 is a first application of a heat radiation source and a counter reflector according to the invention installed in a paper machine.

Referring now to FIG. 4 there is shown a paper machine 15 with a central control panel 16 and an electrical cubicle 17 including power control means and other control means for the paper machine. The paper machine is provided with infra-red radiation heat elements 18 and a counter reflector 19 according to the invention. The IR-elements are covered by a housing or hood 20 for controlled supply of cooling air. The hood 20 is connected to an incoming cooling air conduit 21 and an outgoing cooling air conduit 22 provided with fans 23. For the safe operation of the paper machine in the web drying area there is provided a web rupture indicator 24 and a flame detector 25 co-operating with sprinklers 26.

Figure 5:
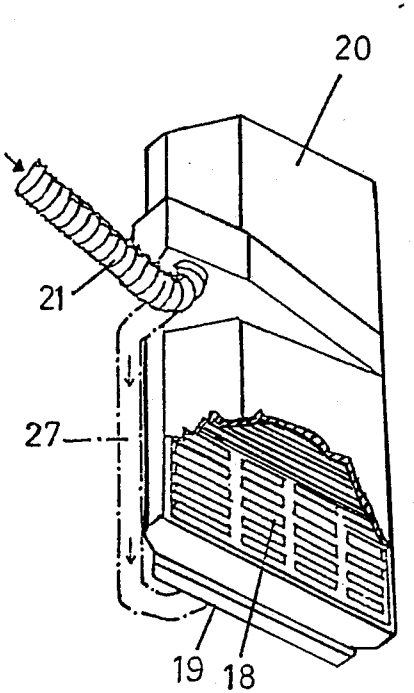
FIG. 5 is a perspective view—corresponding to a part of FIG. 4—of a modified application of a reflector—counter-reflector-arrangement according to the invention.

FIG. 5 shows a modified web drying unit in which the outgoing cooling air conduit 22 is replaced by an only in principle shown hot air transfer conduit 27, which is connecting the housing 20 with the gas feed means 9 and the chamber 14 of the counter reflector 19. The thus preheated air to the counter reflector 19 is emerging through the hollow rivets or screws 6' and through the slots 11, 12, 13 between the boxes 3 of the counter reflector. In this way the heat ventilated away from the IR-radiation heat elements 18 and their electrical supply conduits can be used for the drying of the paper web 28.

A fan 23 may be provided in the hot air transfer conduit 27 in order to increase the amount and pressure of heated gas supply to the inner chamber 14.

FIG. 4 shows a paper machine in which the paper web is passing between a radiant heat source and a counter reflector as a single-guided continuous paper web. However, the shape of the paper web may also be such, that the paper web passes two or more times between the radiant heat source and the counter reflector as a multiple-guided continuous paper web.

I claim:

1. A counter reflector, for use in drying a moving web, comprising:

a longitudinally extending frame;

at least one reflective shield element, having openings therein, being attached to a front face of said frame and a plate member being attached to a rear face of said frame;

an interior chamber being defined by said frame, said at least one shield element and said plate member; and gas supply means, communicating with said interior chamber, for supplying gas to the interior of the counter reflector for removing excess absorbed radiated heat therefrom, the heat gas being exhausted from said interior chamber through said openings in said at least one reflective shield element for assisting in drying of a moving web;

the improvement wherein said at least one reflective shield element has an insulating backing layer, disposed on its surface adjacent said interior chamber, for preventing undesired cooling of said shield element.

2. A counter reflector according to claim 1, wherein said shield element is made from a material selected from the group consisting of glass, ceramic material, ceramic material coated with glass and glass coated with a ceramic material.

3. A counter reflector according to claim 1, wherein said shield element is made from at least one material selected from the group consisting of steel and nickel.

4. A counter reflector according to claim 3, wherein said shield element is coated with a material selected from the group consisting of alumina oxide and magnesium oxide by spraying.

5. A counter reflector according to claim 1, wherein said shield element is rectangular in shape and has hole means cooperating with fastening means for attaching said shield element to said frame.

6. A counter reflector according to claim 5, wherein tray means are provided for supporting said insulating backing layer and said shield element to a lattice support structure of said frame.

7. A counter reflector according to claim 6, wherein each said tray means contains 6 reflective shield elements.

8. A counter reflect according to claim 7, wherein 6 tray means are used, each having 6 reflective shield elements.

9. A counter reflector according to claim 8, wherein a longitudinally and at least one traversely extending slot, are provided between adjacent tray means, for exhausting the heated gas.

10. A method of drying a continuous web comprising:

treating one side of said continuous web with radiant energy from infra-red radiation elements;

using a counter reflector according to claim 11, positioned on the other side of said continuous web opposite said radiation elements to reflect and absorb the radiated energy, supplying air to cool the infrared radiating elements and supplying that heat air to the gas supply means to provide further heated air to the space between the counter reflector and the continuous web.

* * * * *

UNITED STATES PATENT AND TRADEMARK OFFICE

CERTIFICATE OF CORRECTION

PATENT NO. : 4,915,154
DATED : April 10, 1990
INVENTOR(S) : Per PERSSON

It is certified that error appears in the above—identified patent and that said Letters Patent is hereby corrected as shown below:

Column 4, line 58 - change "11" to --1--.

Signed and Sealed this

Sixteenth Day of July, 1991

*Attest:*

HARRY F. MANBECK, JR.

*Attesting Officer*

*Commissioner of Patents and Trademarks*